US010471971B2

(12) United States Patent
Richardson

(10) Patent No.: US 10,471,971 B2
(45) Date of Patent: Nov. 12, 2019

(54) ZIPLINE TROLLEY

(71) Applicant: Michael Troy Richardson, Washington, UT (US)

(72) Inventor: Michael Troy Richardson, Washington, UT (US)

( * ) Notice: Subject to any disclaimer, the term of this patent is extended or adjusted under 35 U.S.C. 154(b) by 183 days.

(21) Appl. No.: 15/819,499

(22) Filed: Nov. 21, 2017

(65) Prior Publication Data

US 2018/0304907 A1 Oct. 25, 2018

Related U.S. Application Data

(60) Provisional application No. 62/487,954, filed on Apr. 20, 2017.

(51) Int. Cl.

| | |
|---|---|
| ***B61B 12/02*** | (2006.01) |
| ***A63G 21/22*** | (2006.01) |
| ***A63G 21/20*** | (2006.01) |
| ***B61B 7/00*** | (2006.01) |

(52) U.S. Cl.

CPC ..... *B61B 12/028* (2013.01); *A63G 21/20* (2013.01); *A63G 21/22* (2013.01); *B61B 7/00* (2013.01)

(58) Field of Classification Search

CPC ..... A63G 21/20; A63G 21/22; B61B 12/028; B61B 7/00; B61B 12/12; B61B 12/122; B61H 9/02; A62B 1/14

See application file for complete search history.

(56) References Cited

U.S. PATENT DOCUMENTS 8,708,109 B2 * 4/2014 Steele ..... A63G 21/22 104/113
2016/0355197 A1 * 12/2016 Brown ..... B61H 9/02
2017/0284491 A1 * 10/2017 Unno ..... F16D 69/02

* cited by examiner

*Primary Examiner* — Mark T Le
(74) *Attorney, Agent, or Firm* — Kunzler Bean & Adamson

(57) ABSTRACT

For travel on a cable, the zipline trolley includes a wheel, a brake, a frame, a hanger, and a lower slot. The wheel is disposed on a proximal end of a frame. The wheel includes a groove that receives a cable at a lower portion of the wheel and a wheel bearing. The brake is disposed on a distal end of the frame. The brake is connected to a given lever point and includes a groove along a brake bottom that receives the cable. The frame includes an array of lever points disposed between the brake and the wheel. The hanger is connected to a given lever point and suspends a weight. The weight applies a force about the wheel to the brake to control a rate of descent of the device along the cable. The lower slot receives the cable.

18 Claims, 21 Drawing Sheets

ZIPLINE TROLLEY

CROSS REFERENCE TO RELATED APPLICATIONS

This application claims priority to U.S. Provisional Patent Application No. 62/487,954 entitled "zipline trolley" and filed on Apr. 20, 2017 for Michael Troy Richardson, which is incorporated herein by reference.

FIELD

The subject matter disclosed herein relates to a zipline trolley.

BACKGROUND

Description of the Related Art

Zipline trolleys must carry a rider safely down a cable.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

The description of elements in each figure may refer to elements of proceeding figures. Like numbers refer to like elements in all figures, including alternate embodiments of like elements.

Figure 1:
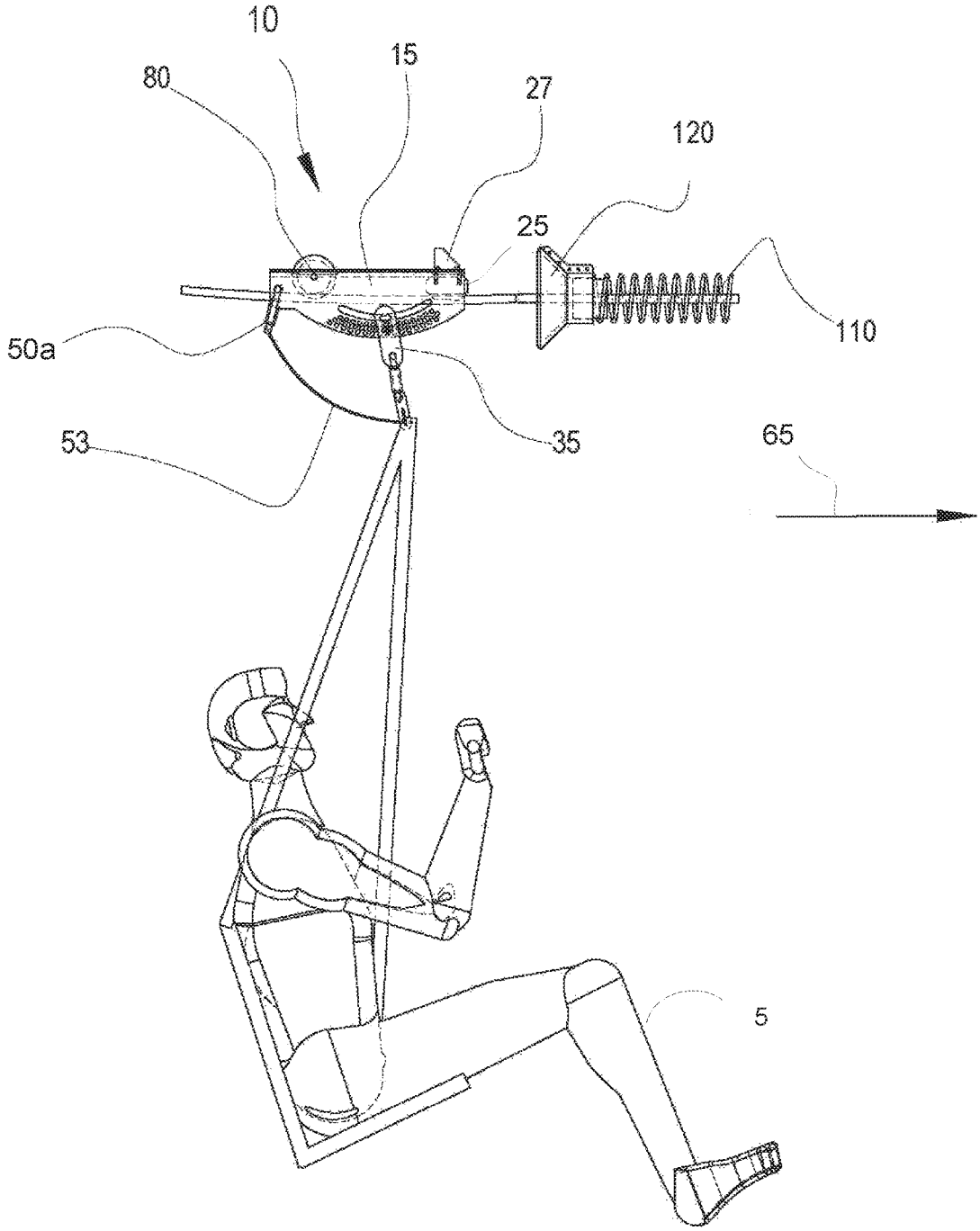
FIG. 1 is a side view drawing of one embodiment of a rider suspended below the zipline trolley.

FIG. 1 is a side view drawing of one embodiment of a rider 5 suspended below the zipline trolley 10. The zipline trolley 10 includes a frame 15, a wheel 20, a wheel bearing 80, a brake 25, a brake stop 27, and a hanger 35. A receiver 120 and spring 110 are also shown. The wheel 20 and the brake 25 may travel along a top of the cable 45. The zipline trolley 10 may travel along a cable 45 in a direction of travel 65. The wheel bearing 80 may be a Sprague bearing.

The zipline trolley 10 may experience a significant acceleration while descending a cable. As a result, it may be important to apply a braking force. Unfortunately, in the past, brakes have been large in order to provide a sufficient braking force. In addition, the zipline trolleys have been large, making it difficult to remove the trolleys from the cable 45. The embodiments described herein provide a brake 25 that provides a sufficient braking force within a small volume. As a result, the zipline trolley 10 may be constructed in a small size that is easily removed from the cable 45.

The zipline trolley 10 may make contact with the receiver 120 and may compress the spring 110 or series of springs. If compression occurs, the Sprague wheel bearing 80 will limit roll back of the zipline trolley 10. This view also shows the safety strap 53 connected to a distal carabineer 50*a*.

Figure 2:
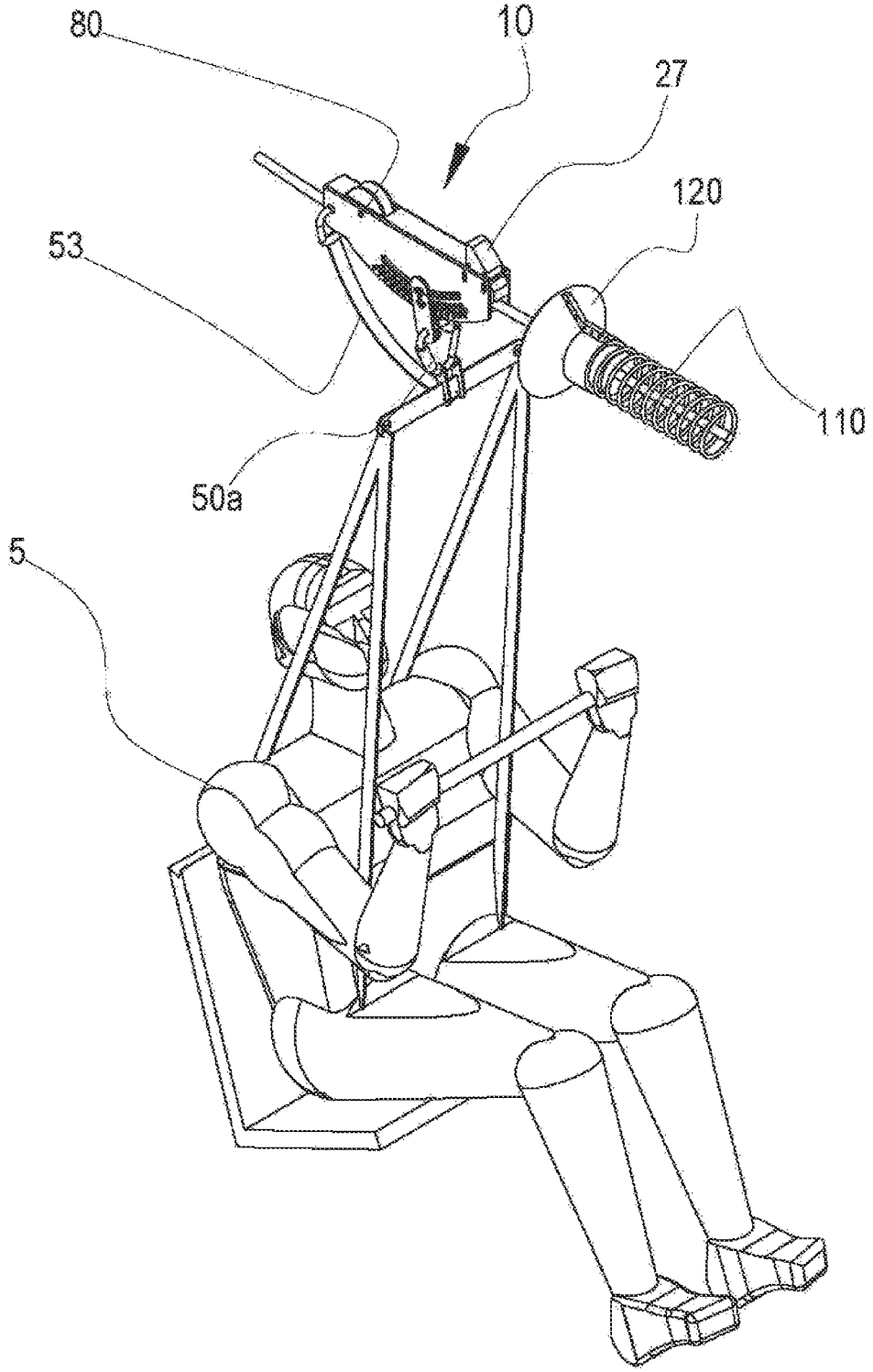
FIG. 2 is a top isometric view drawing showing one embodiment of the brake stop.

FIG. 2 is a top isometric view drawing showing one embodiment of the brake stop 27. As the zipline trolley 10 traverses the cable 45, the zipline trolley 10 may make contact with the receiver 120. The receiver 120 may apply additional downward force on the brake stop 27 to increase the braking force of the brake. The brake stop 27 may compress the spring 110 to further slow the zipline trolley 10, increasing safety for the rider 5.

Figure 3:
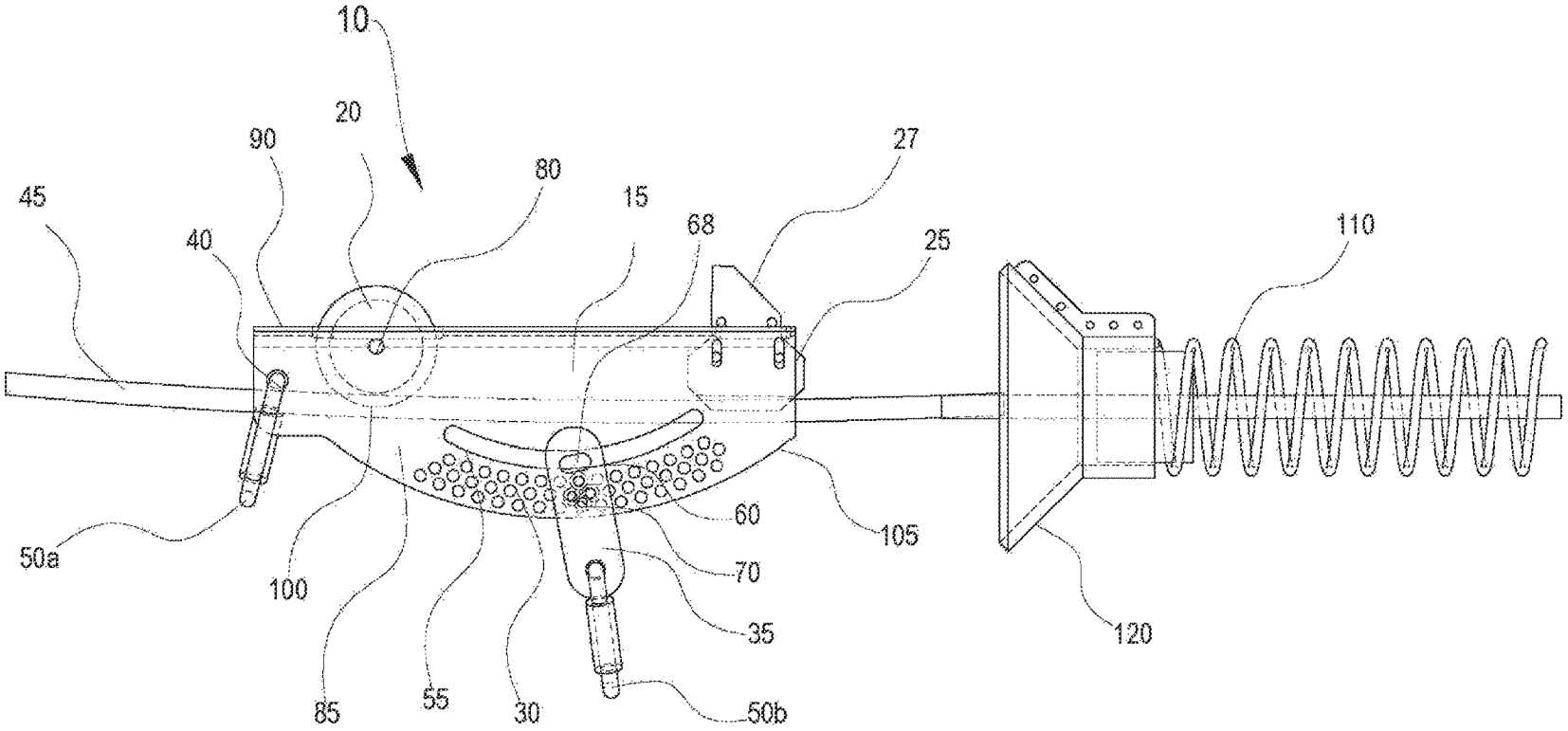
FIG. 3 is a side view cutaway drawing illustrating one embodiment of a zipline trolley.

FIG. 3 is a side view cutaway drawing illustrating one embodiment of a zipline trolley 10. The zipline trolley 10 may carry a rider suspended from a second carabiner 50*b*. The zipline trolley 10 may travel along a cable 45 in a direction of travel 65. In the depicted embodiment, the zipline trolley 10 includes a wheel 20, a frame 15, a brake 25, a lower slot 85, sliding bar 68, receiver 120, spring 110, and a hanger 35. In this view, the zipline trolley 10 may have stopped before impacting the receiver 120 and compressing the spring 110 or series of springs. This view also shows the brake stop 27 which may be forced down upon impact with the receiver 120 to initiate a downward force on the brake stop 27 causing the zipline trolley to decelerate. This view also shows a safety pin 68 passing through the slots of the hanger 35 and the frame 15.

The wheel 20 may be disposed on a distal end 90 of the frame 15. The wheel 20 includes a groove that receives the cable 45 at a lower portion 100 of the wheel 20. In addition, the wheel 20 includes a wheel bearing 80. The wheel bearing 80 may be selected from the group consisting of a Sprague bearing or a trapped bearing. In addition, the wheel bearing 80 may include a spring or configuration that may inhibit roll back when gravity or a compressing spring pack which slows the trolley 10. In one embodiment, the wheel bearing 80 prevents rollback at a stopping point. The stopping point may be at or near the end of the cable 45. The spring 110 and receiver 120 may cushion the impact of the zipline trolley 10 reaching the stopping point.

The brake 25 may be disposed on a proximal end 105 of the frame 15. If the rider 5 and the zipline trolley 10 makes contact with the receiver 120, the brake stop 27 portion of the brake 25 may contact the receiver 120, applying a downward sheering fricative force on the cable 45 as the zipline trolley 10 transverses the cable 45.

The brake 25 includes a groove along a brake bottom that receives the cable 45. The brake 25 traverses the top of the cable 45. As a result, the operation of the brake 25 is not diminished by moisture on the cable 45, as the moisture migrates to the bottom of the cable 45.

In one embodiment, the brake 25 is formed of a material with a melting point in excess of 200° F. In addition, the brake 25 may be formed of a material with a melting point in excess of 300° F.

The frame 15 includes an array of lever points 30. The array of lever points 30 is disposed between the brake 25 and the wheel 20. A given lever point 30 may be selected as a function of the slope of the zipline. In addition, the given lever point 30 may be selected as a function of a desired maximum speed of the zipline trolley 10. The frame 15 may be formed of one or more of ultra-high molecular weight polyethylene (UHMW), Stainless Steel, Titanium, and high strength carbon steel.

The hanger 35 is connected to a given lever point 30. The hanger 35 may be connected by a hanger connector 70. The hanger 35 may be further connected to the frame 15 by a sliding bar 68 that passes through right and left slider groves 55. As a result, the sliding bar 60 and hanger 35 cannot be detached from the frame 15 without removing the sliding bar 60 from the hanger 35.

A weight such as the rider 5 may be suspended from the hanger 35. In one embodiment, the weight is suspended from the hanger 35 using a proximal carabiner 50*b*. The weight may apply an angular force about the wheel 20 to the brake 25. The force about the wheel 20 causes the brake 25 to apply a fricative force to the cable 45. The force on the brake 25 may control the rate of dissent of the zipline trolley 10 along the cable 45. The force may be applied with a high force to surface area ratio. In one embodiment, the fricative force of the brake 25 is significantly more for the zipline trolley 10 in the direction of travel 65 then against the direction of travel 65. In an alternate embodiment, the zip line trolley 10 may be used to carry a rider 5 against the direction of travel 65 to reduce the fricative force of the brake 25.

The lower slot 85 receives the cable 45. The zipline trolley 10 may be set on the cable 45 and removed from the cable 45 if the hanger 35 is removed from the given lever point 30 and the sliding bar 60 is removed. Because of the high force to surface area ratio, the size of the brake 25 and the zipline trolley 10 may be reduced. As a result, the zipline trolley 10 may be easily placed on the cable 45 at the top of the cable 45 and/or removed from the cable 45 at the bottom of the cable 45.

In one embodiment, the zipline trolley 10 includes safety carabiner holes 40 disposed in the frame 15 and above the cable 45. The distal carabiner 50*a* may be inserted through the carabiner holes 40 and around the cable 45. As a result, the zipline trolley 10 is securely connected to the cable 45.

Figure 4:
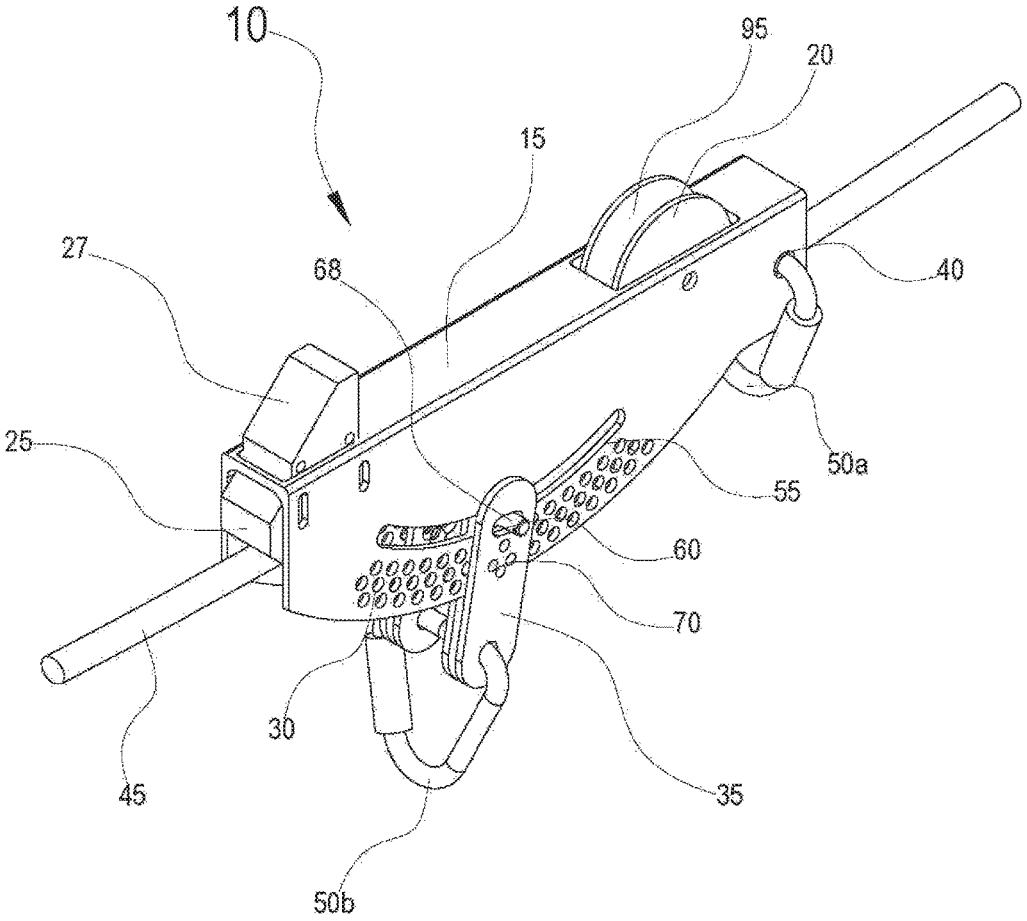
FIG. 4 is a perspective drawing illustrating one embodiment of a zipline trolley.

FIG. 4 is a perspective drawing illustrating one embodiment of the zipline trolley 10. The wheel 20 includes the groove 95. The groove 95 may receive the cable 45 at the lower portion of the wheel 20.

Figure 5:
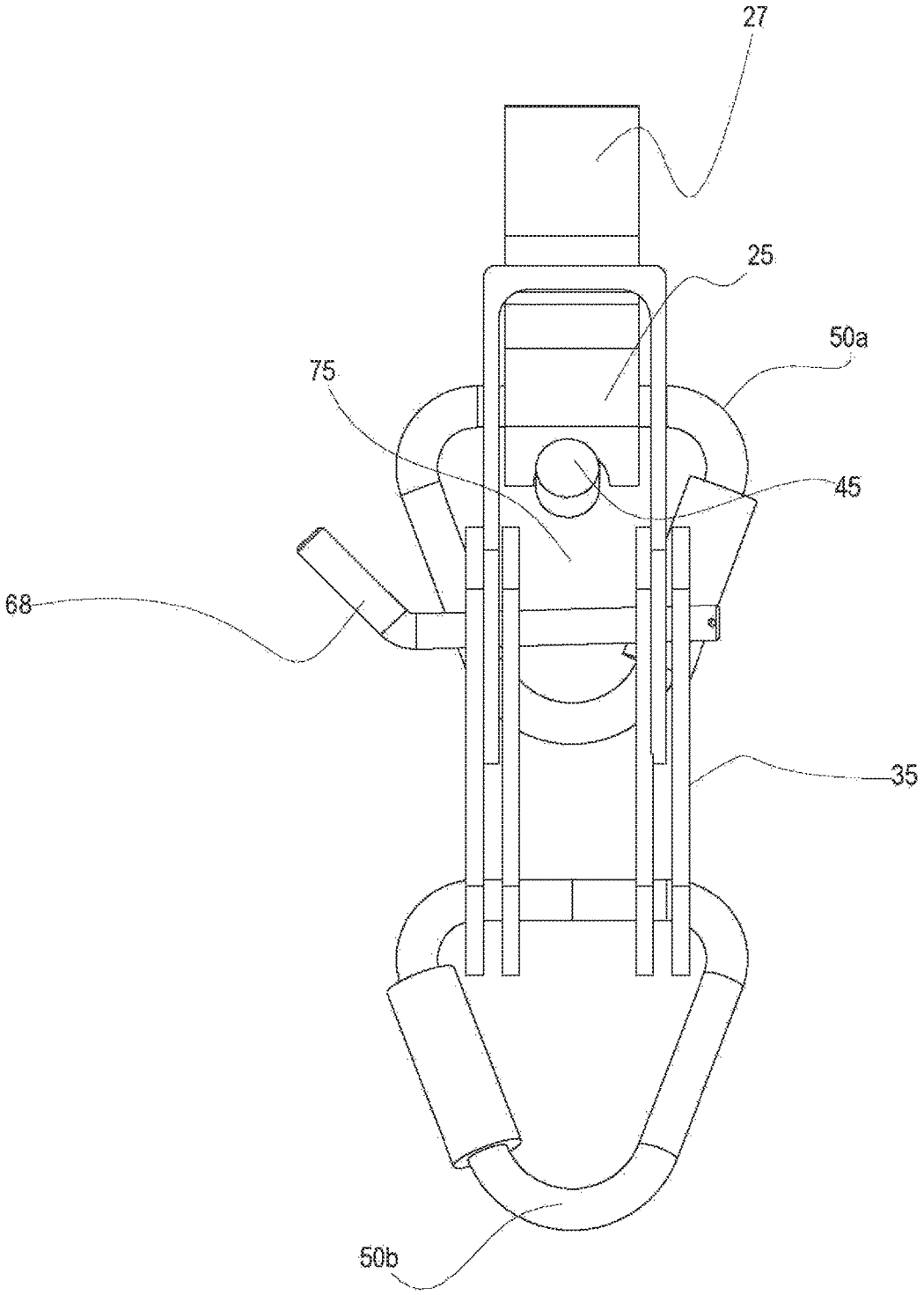
FIG. 5 is a front-view drawing illustrating one embodiment of a zipline trolley.

FIG. 5 is a front-view drawing illustrating one embodiment of the zipline trolley 10. The lower slot 85 is shown. If the carabineers 50*a-b* and the sliding bar 68 are removed from the given lever point 30, the zipline trolley 10 may be set on the cable 45 and/or removed from the cable 45.

Figure 6:
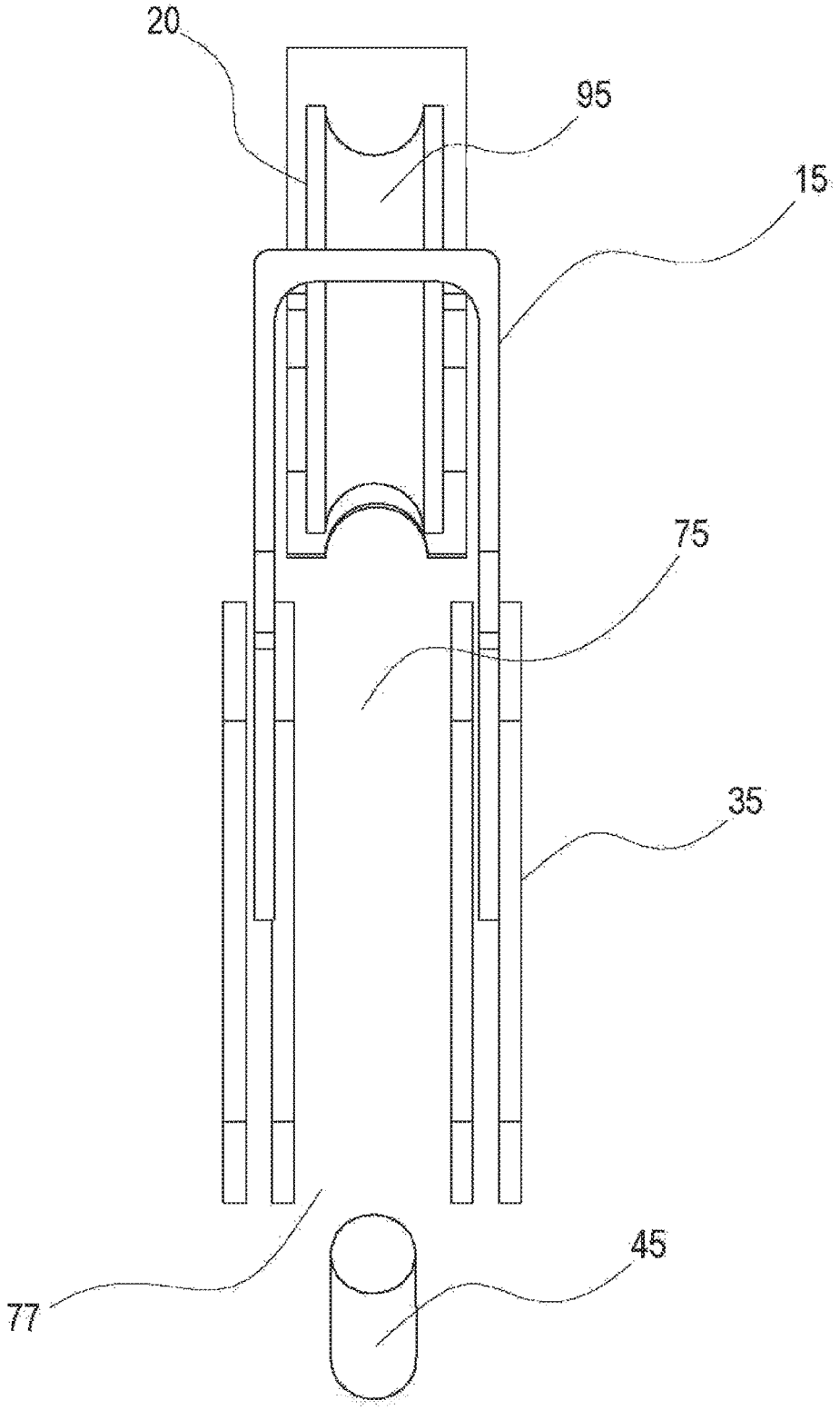
FIG. 6 is a rear-view drawing illustrating one embodiment of the zipline trolley.

FIG. 6 is a rear-view drawing of one embodiment the zipline trolley 10 with the slider bar 68 and the carabineers 50*a-b* removed. The zipline trolley 10 may be set on the cable 45 at an opening 77. The zipline trolley 10 may be lifted from the cable 45 at the clearance 75. The hanger 35 may remain connected to the frame 15 when removing the zipline trolley 10 from the cable 45.

Figure 7:
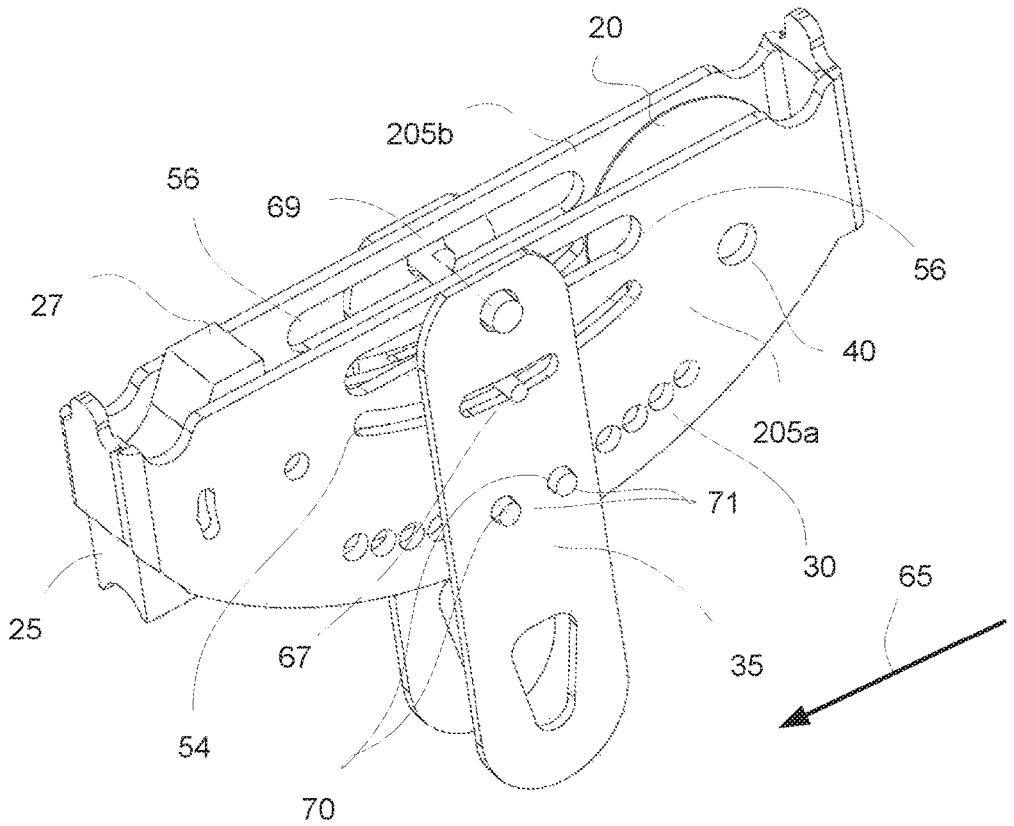
FIG. 7 is a perspective drawing illustrating one alternate embodiment of a zip line trolley.

FIG. 7 is a perspective drawing illustrating one alternate embodiment of the zip line trolley 10. In the depicted embodiment, the hanger 35 is connected to the zip line trolley 10 by an upper sliding bar 69 and a lower sliding bar 67. The upper sliding bar 69 is disposed in an upper sliding groove 56. The lower sliding bar 67 is disposed in a lower sliding groove 54. The upper sliding bar 69 and the lower sliding bar 67 may be free to slide within the upper sliding groove 56 and the lower sliding groove 54 respectively Plunger pins 71 protrude through the lever points 30 and the hanger connector 70 to set a lever angle that adjusts the angular force that is applied about the wheel 20 to the brake 25. The plunger pins 71 may be set to protrude through any pair of lever points 30. The force about the wheel 20 causes the brake 25 to apply a fricative force to the cable 45. Selecting lever points 30 toward the direction of travel 65 increases the force about the wheel 20 that is applied by the brake 25 to the cable 45. Selecting lever points 30 away from the direction of travel 65 decreases the force about the wheel that is applied by the brake 25 to the cable 45. The lever points 30 may be selected based on the slope of the cable 45. If the slope of the cable 45 is steep, lever points 30 near to the brake 25 may be selected to increase the force of the brake 25. If the slope of the cable 45 is shallow, lever points 30 farther from the brake 25 may be selected to decrease the force of the brake 25. The force on the brake 25 may control the rate of dissent of the zipline trolley 10 along the cable 45. The force may be applied with a high force to surface area ratio.

In one embodiment, two trolley body components 205 form the frame 15. The trolley body components 205 may be fabricated separately and assembled together to reduce manufacturing costs.

Figure 8:
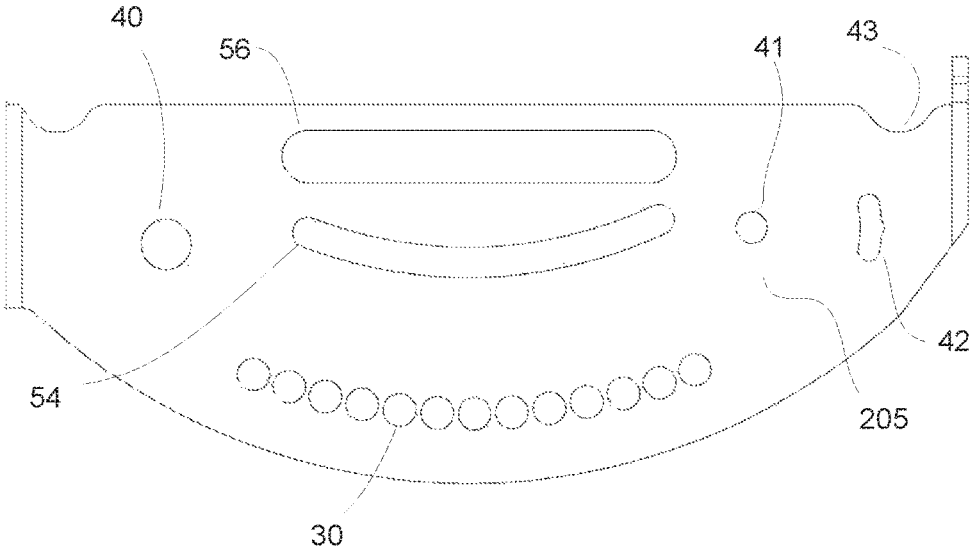
FIG. 8 is a side view drawing illustrating one embodiment of a trolley body component.

FIG. 8 is a side view drawing illustrating one embodiment of the trolley body component 205. In the depicted embodiment, the trolley body component 205 includes the upper slider groove 56, the lower slider groove 54, the lever points 30, the safety carabiner holes 40, a brake hole 41, a brake adjustment hole 42 and an active brake groove 43.

The brake adjustment hole 42 may receive a brake pin, connect the brake 25 to the frame 15, and allow the contact of the brake 25 on the cable 45 to be adjusted. The brake hole 41 may also receive a brake pin and connect the brake 25 to the frame 15.

Figure 9:
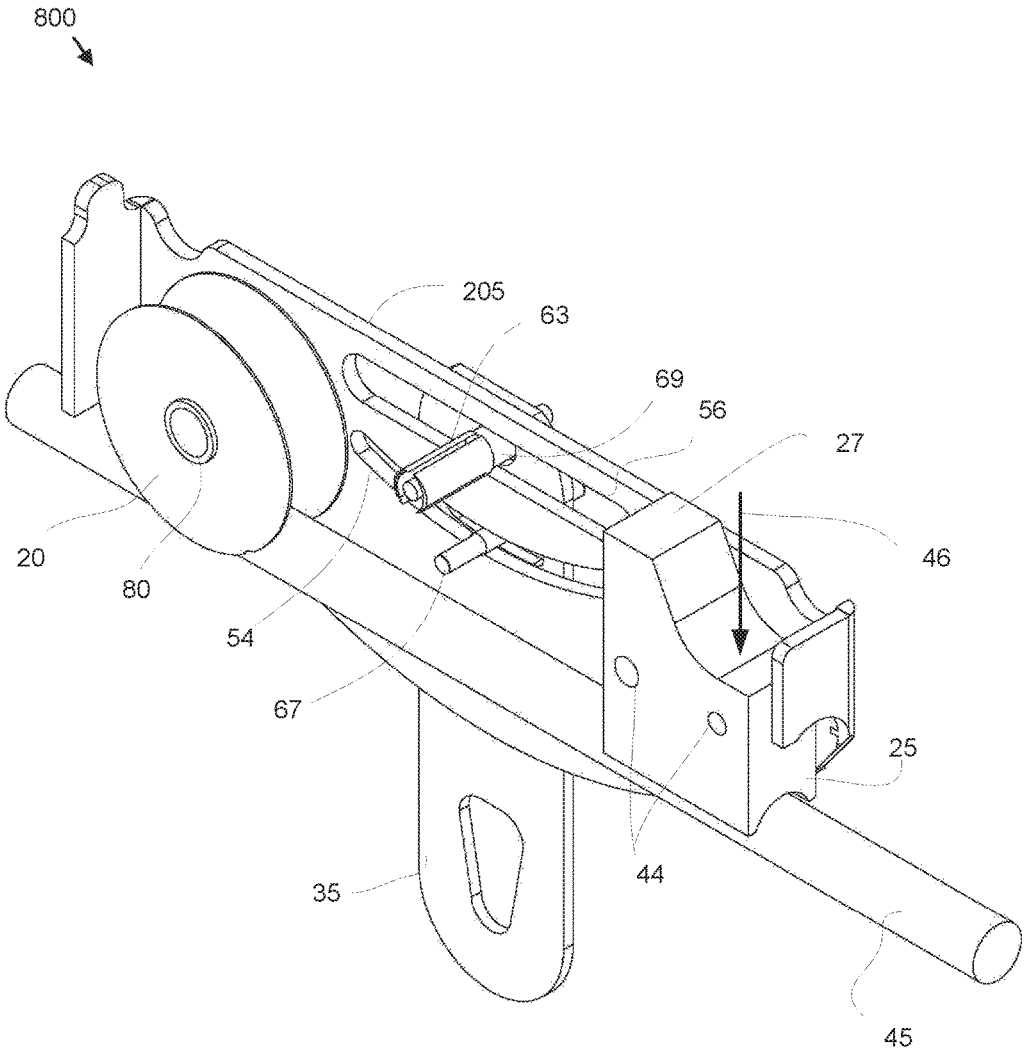
FIG. 9 is a perspective drawing illustrating one embodiment of a zip line trolley interior.

FIG. 9 is a perspective drawing illustrating one embodiment of a zip line trolley interior. In the depicted embodiment, one trolley body component 205 is removed to show the interior of the zip line trolley 10. Brake pins 44 are shown embedded in the brake 25. The brake pins 44 may be set in the brake hole 41 and the brake adjustment hole 42 such that the brake 25 is secured to the frame 15. In addition, the brake pin 44 in the brake adjustment hole 42 may be moved within the brake adjustment hole 42 to adjust the contact of the brake 25 on the cable 45.

If an active braking force 46 is applied to the brake 25, the force applied by the brake 25 to the cable 45 is increased, increasing the fricative resistance of the brake 25 and further slowing the zip line trolley 10.

In the depicted embodiment, the upper sliding bar 69 includes a bar sleeve 63. The bar sleeve 63 may connect to another bar sleeve 63 and/or another upper sliding bar 69 extending from the other trolley body component 205 to connect the upper sliding bars 69.

Figure 10:
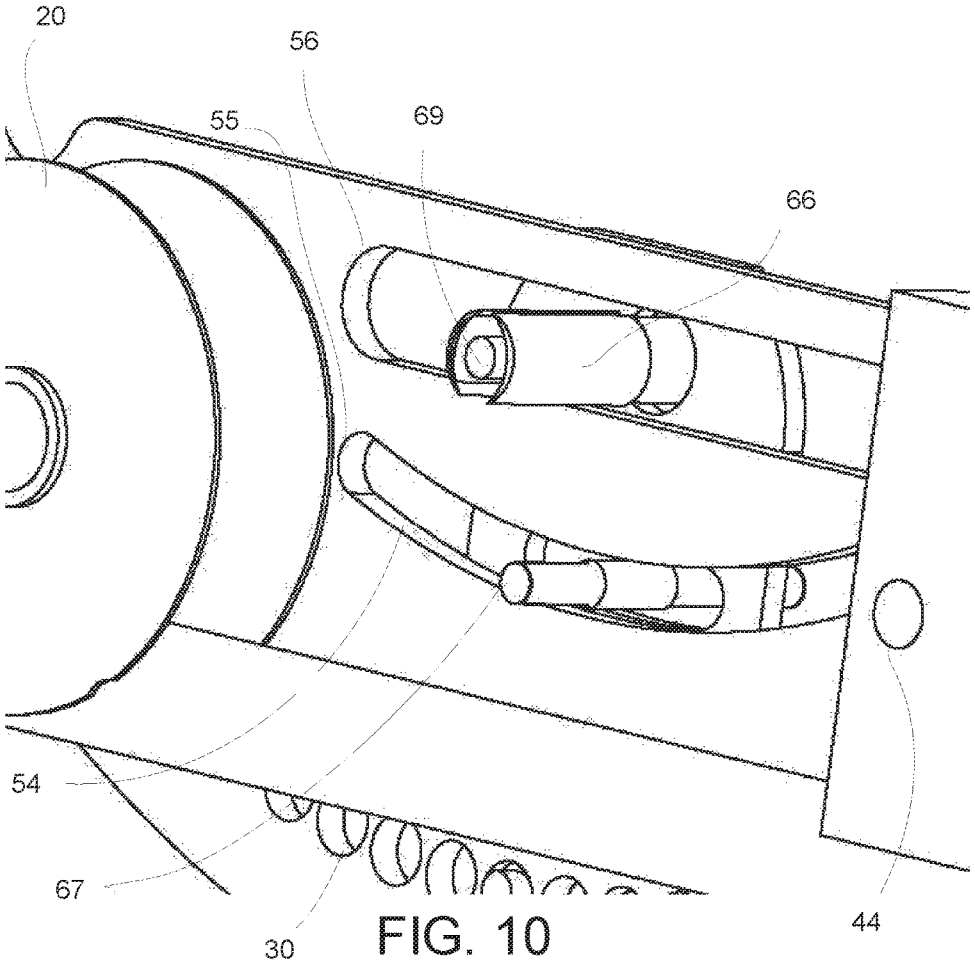
FIG. 10 is a perspective drawing illustrating one embodiment of a zip line trolley interior.

FIG. 10 is a perspective drawing illustrating one embodiment of the zip line trolley interior. In the depicted embodiment, the brake pin 44 and the bar sleeve 63 are shown in greater detail.

Figure 11:
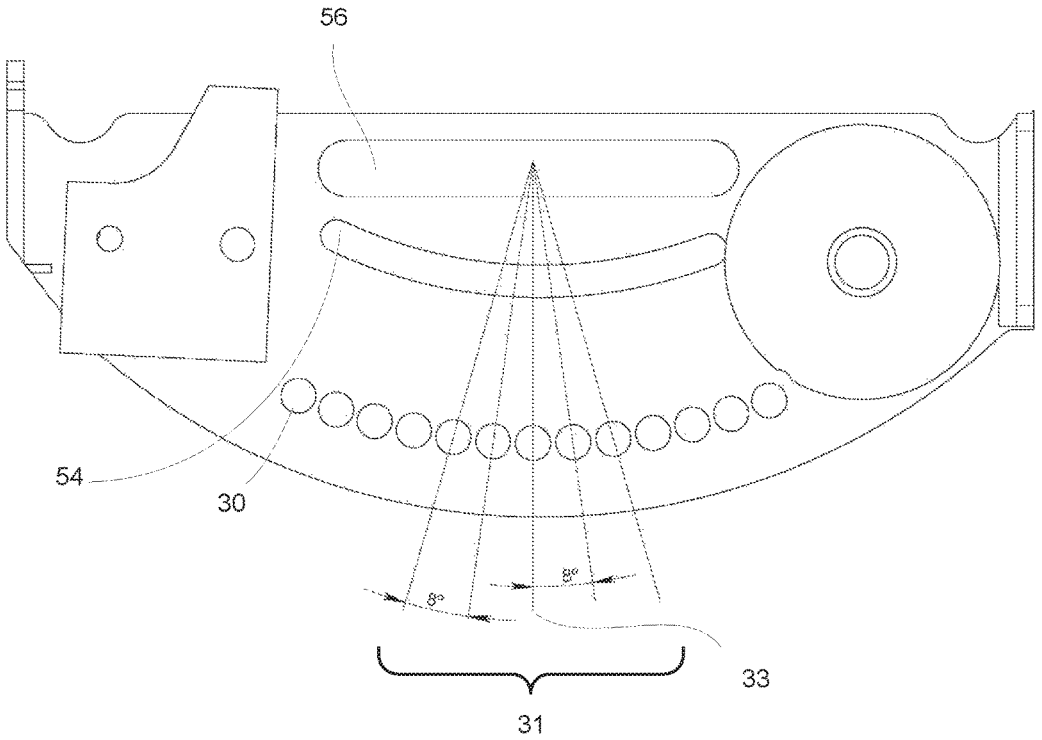
FIG. 11 is a side view drawing illustrating one embodiment of lever angles for a zip line trolley.

FIG. 11 is a side view drawing illustrating one embodiment of lever angles 31 for the zip line trolley 10. In the depicted embodiment, lever angles 31 are shown for a hanger 35 (not shown) connected to the upper sliding bar 69 (not shown) in the upper sliding groove 56, the lower sliding bar 67 (not shown) in the lower sliding groove 54, and plunger pins 71 (not shown) in the lever points 30, with the plunger pins 71 determining the lever angles 31. In the depicted embodiment, the lever angles 31 are separated by 8°. Any combination of lever angles 31 may be provided. Table 1 shows normalized brakes forces for exemplary braking angles 31 measured from a baseline angle 33.

TABLE 1

| Lever Angle 31 (degrees) | Normalized Braking Force |
|---|---|
| 35.7 | 1 |
| 35.0 | 1.015725025 |
| 34.0 | 1.037466882 |
| 33.0 | 1.060356854 |
| 32.0 | 1.080765615 |
| 31.0 | 1.102280187 |
| 30.1 | 1.121305045 |
| 29.0 | 1.143753168 |
| 28.0 | 1.163685074 |
| 27.0 | 1.184609043 |
| 26.0 | 1.203033626 |
| 23.0 | 1.259361973 |

TABLE 1-continued

| Lever Angle 31 (degrees) | Normalized Braking Force |
|---|---|
| 22.0 | 1.27801731 |
| 21.0 | 1.29531478 |
| 20.0 | 1.312342263 |
| 19.0 | 1.329082816 |
| 18.0 | 1.345519627 |
| 17.0 | 1.361636069 |
| 16.0 | 1.377415744 |
| 15.0 | 1.392842532 |
| 14.0 | 1.406970608 |
| 13.0 | 1.421669081 |
| 12.0 | 1.435969403 |
| 11.0 | 1.449001414 |
| 10.0 | 1.461659132 |
| 9.0 | 1.474735605 |
| 8.0 | 1.486585022 |
| 7.0 | 1.498027507 |
| 6.0 | 1.50977348 |
| 5.2 | 1.518265324 |

The braking force is thus a function of the braking angle 31. The braking angle 31 can be adjusted to match the slope of the cable 45, with more braking force applied for steeper slopes of the cable 45. In addition, the braking force is dynamically modified as the slope of the cable 45 changes. For example, for any braking angle 31, the braking force is increased for a steeper slope of a first portion of the cable 45 and the braking force is decreased for a shallower slope for a second portion of the cable 45. As a result, the braking force dynamically adjusts to the slope of the cable 45.

Figure 12:
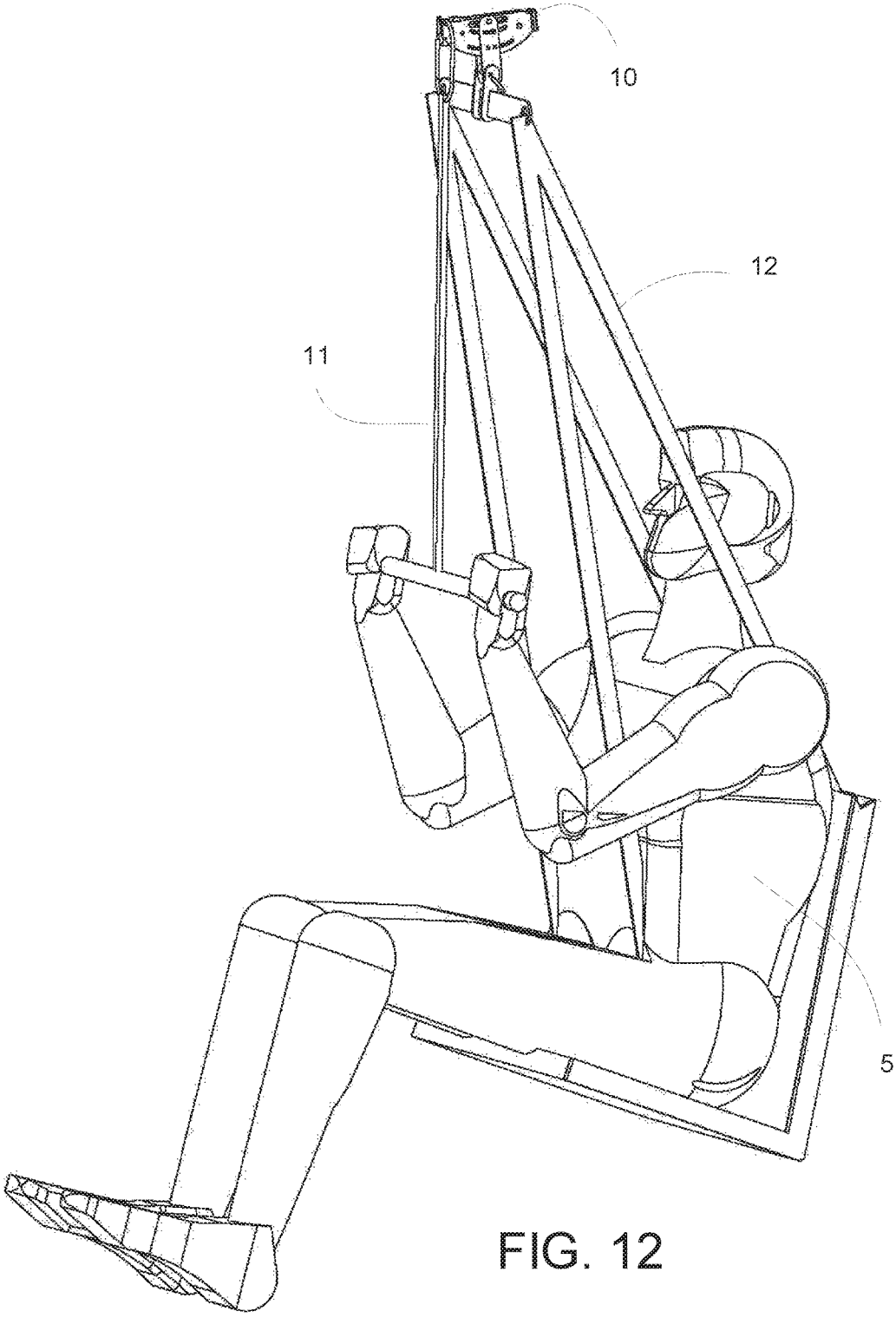
FIG. 12 is a perspective drawing illustrating one embodiment of a rider suspended below a zip line trolley with an active brake.

FIG. 12 is a perspective drawing illustrating one embodiment of the rider 5 suspended below a zip line trolley 10 with an active brake 11. In the depicted embodiment, the rider 5 is disposed in a harness 12. In addition, the rider 5 holds the active brake 11. The active brake 11 may be a rope, a cable, structure, and the like. The rider 5 may pull down on the active brake 11 to apply the active braking force 46 to the brake 25 and increase the fricative resistance of the brake 25 on the cable 45. As a result, the rider 5 can actively further slow the zip line trolley 10.

Figure 13:
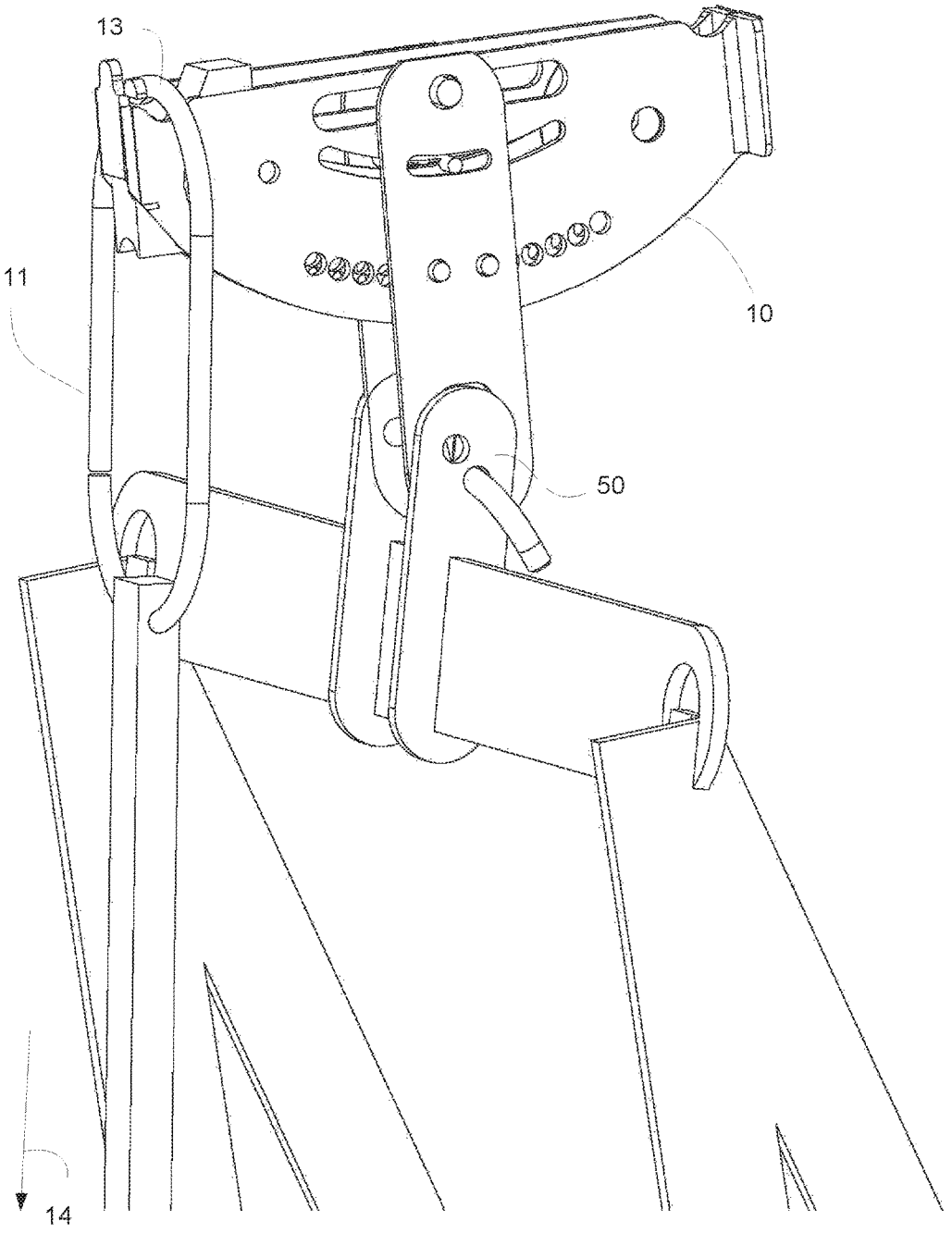
FIG. 13 is a perspective drawing illustrating one embodiment of a zip line trolley with an active brake.

FIG. 13 is a perspective drawing illustrating one embodiment of the zip line trolley 10 with the active brake 11. In the depicted embodiment, a proximal active brake 13 passes through the active brake groove 43. As a result, when the rider 5 pulls on the active brake 11 in an active brake direction 14, the active braking force 46 is applied to the brake 25, increasing the fricative braking force of the brake 25.

Figure 14A:
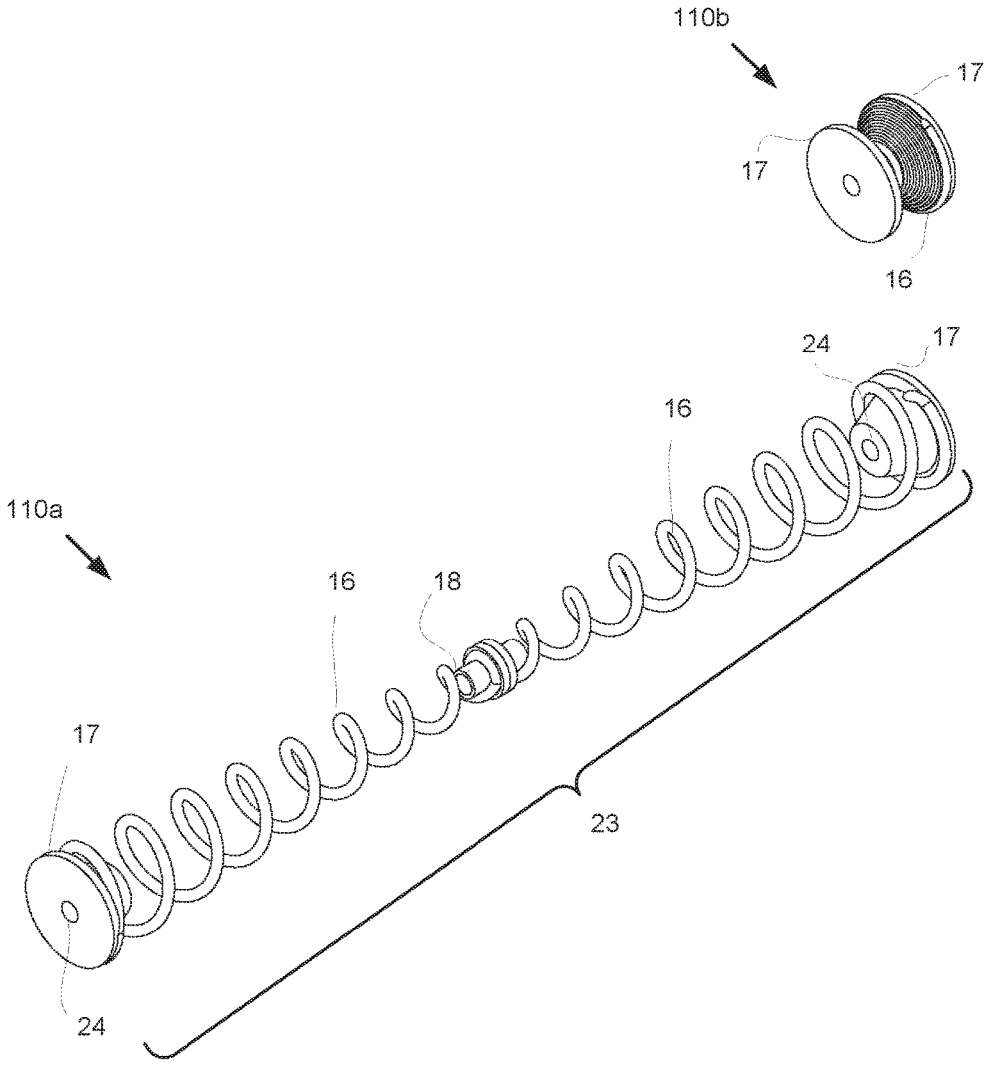
FIG. 14A is a perspective drawing illustrating one embodiment of a spring.

FIG. 14A is a perspective drawing illustrating one embodiment of a spring 110. In the depicted embodiment, an uncompressed spring 110*a* and a compressed spring 110*b* are shown for one spring segment 23. A spring segment 23 may include spring coils 16, one or more end caps 17, and a guide 18. In one embodiment, the spring coils 16 may be formed as a single helical hourglass. Alternatively, the spring coils 16 may be formed as two helical cones. The spring coils 16 may have a slope such that when the spring segment 23 is compressed, each spring coils 16 nests within a neighboring spring coils 16 as shown in FIG. 14I. As a result, the spring segment 23 may be compressed from a long length to a short length.

In one embodiment, the guide 18 connects two helical cone spring coils 16. In addition, the guide 18 may guide the cable 45 through the center of the spring segment 23. The end caps 17 may terminate the spring coils 16. In one embodiment, the cable 45 passes through a hole 24 in each end cap 17. The hole 24 may receive a portion of the brake stop 27 to increase the braking force.

The spring segment 23 comprises a plurality of spring coils 16. The brake stop 27 contacts the spring segment 23 and compresses the spring segment 23. In one embodiment, an end cap 17 of the spring segment 23 contacts the brake stop 27. The brake stop 27 may compress the spring coils 16 of the spring segment 23. The spring coils 16 of the compressed spring segment 23 may nest completely within a neighboring spring coil 16.

Figure 14B:
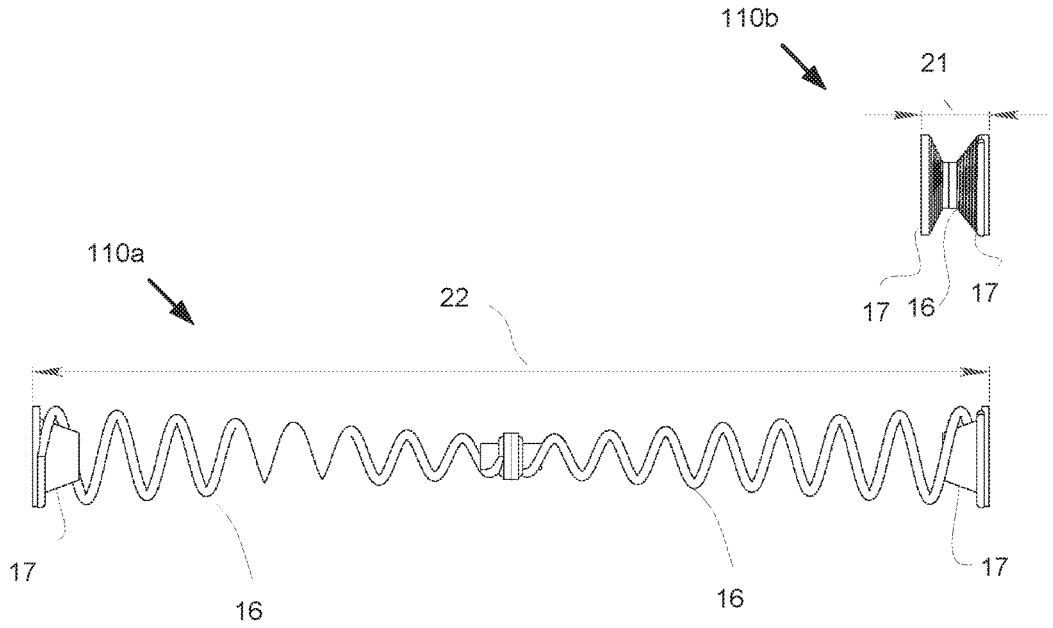
FIG. 14B is a side view drawing illustrating one embodiment of a spring.

FIG. 14B is a side view drawing illustrating one embodiment of the spring 110 of FIG. 14A. In the depicted embodiment, one spring segment 23 has an uncompressed length 22. The uncompressed length 22 may be in the range of 2 to 6 inches. In addition, the spring segment 23 has a compressed length 21. The compressed length 21 may be in the range of 0.5 to 2.25 inches.

Figure 14C:
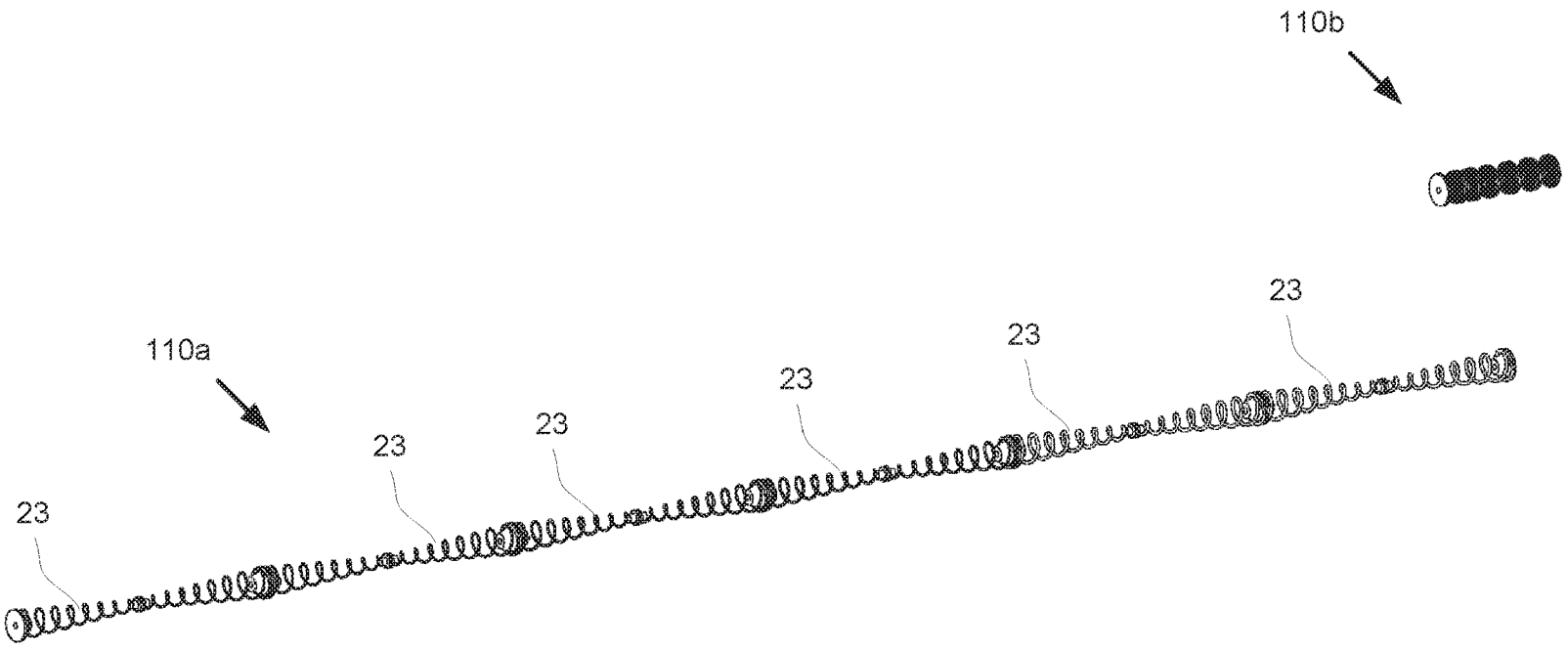
FIG. 14C is a perspective drawing illustrating one embodiment of a spring.

FIG. 14C is a perspective drawing illustrating one embodiment of a spring 110. In the depicted embodiment, the spring 110 is shown as a compressed spring 110*b* and an uncompressed spring 110*a*. The spring 110 includes a plurality of spring segments 23.

Figure 14D:
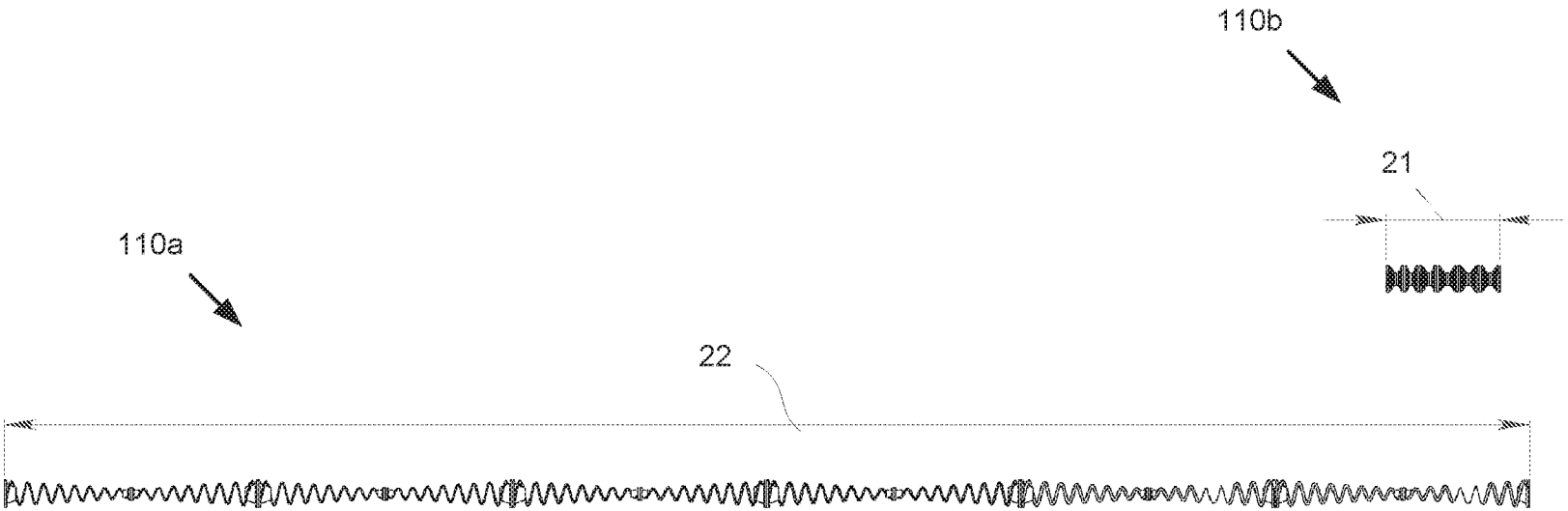
FIG. 14D is a side view drawing illustrating one embodiment of a spring.

FIG. 14D is a side view drawing illustrating one embodiment of the spring 110 of FIG. 14C. The uncompressed spring 110*a* may have an uncompressed length 22 in the range of 16 to 20 feet. In addition, the compressed spring 110*b* may have a compressed length 21 in the range of 1 to 2 feet.

Figure 14E:
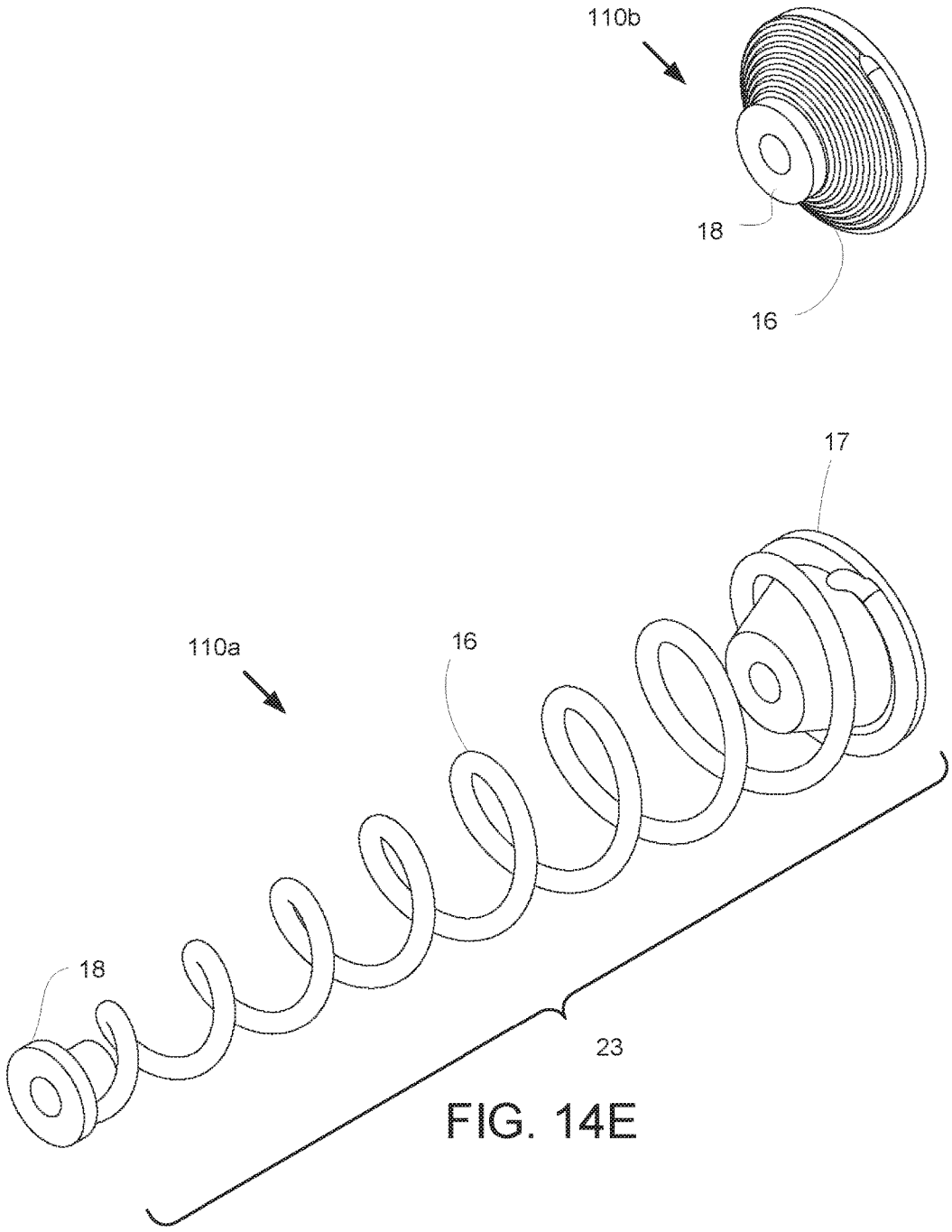
FIG. 14E is a perspective drawing illustrating one embodiment of a spring.

FIG. 14E is a perspective drawing illustrating one embodiment of a spring 110. In the depicted embodiment, a spring segment 23 includes a single helical cone of spring coils 16. The spring 110 is shown as an uncompressed spring 110*a* and a compressed spring 110*b*.

Figure 14F:
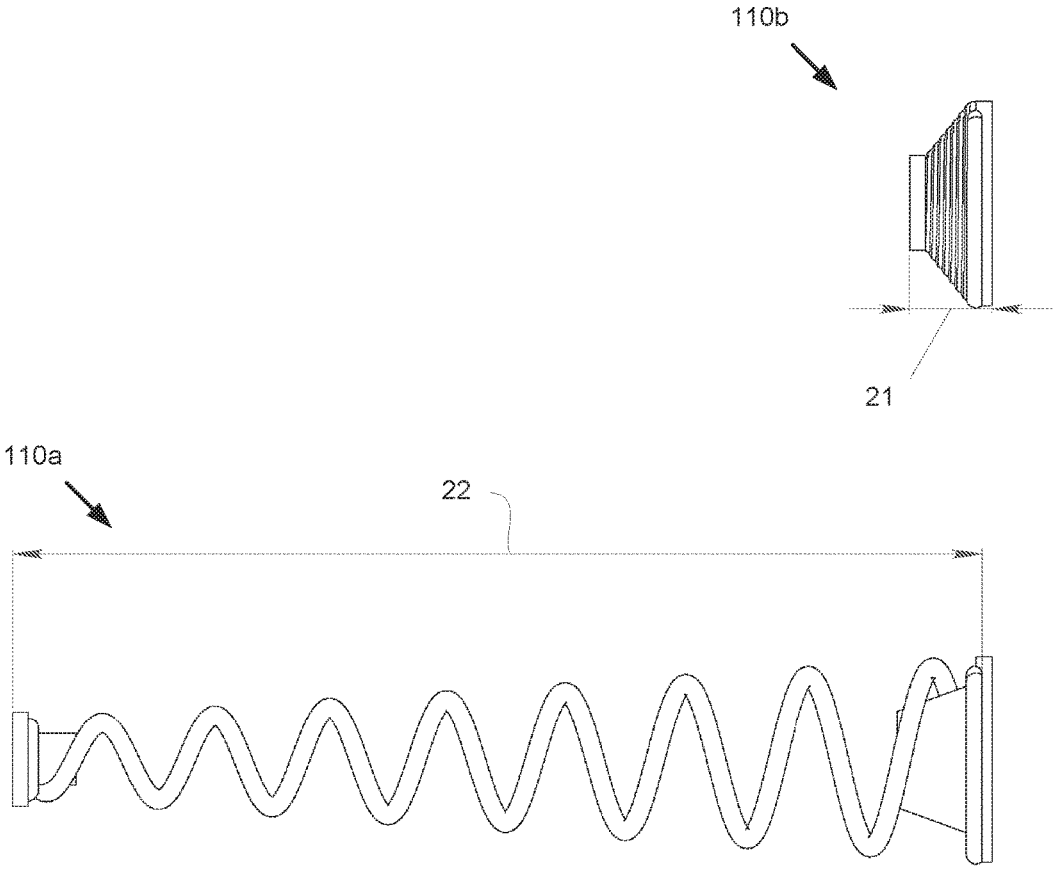
FIG. 14F is a side view drawing illustrating one embodiment of a spring.

FIG. 14F is a side view drawing illustrating one embodiment of the spring 110 of FIG. 14E. The uncompressed spring 110*a* has an uncompressed length 22. The uncompressed length 22 may be in the range of 1 to 4 inches. The compressed spring 110*b* has a compressed length 21. The compressed length 21 may be in the range of 0.5 to 1.5 inches.

Figure 14G:
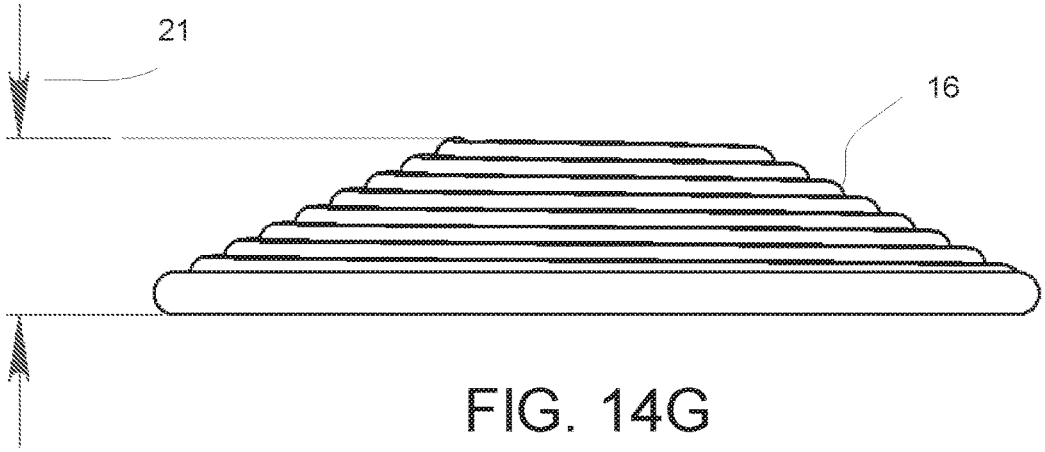
FIG. 14G is a side view drawing illustrating one embodiment of a spring.

FIG. 14G is a side view drawing illustrating one embodiment of the spring coils 16 of a compressed spring 110*b* with the compressed length 21.

Figure 14H:
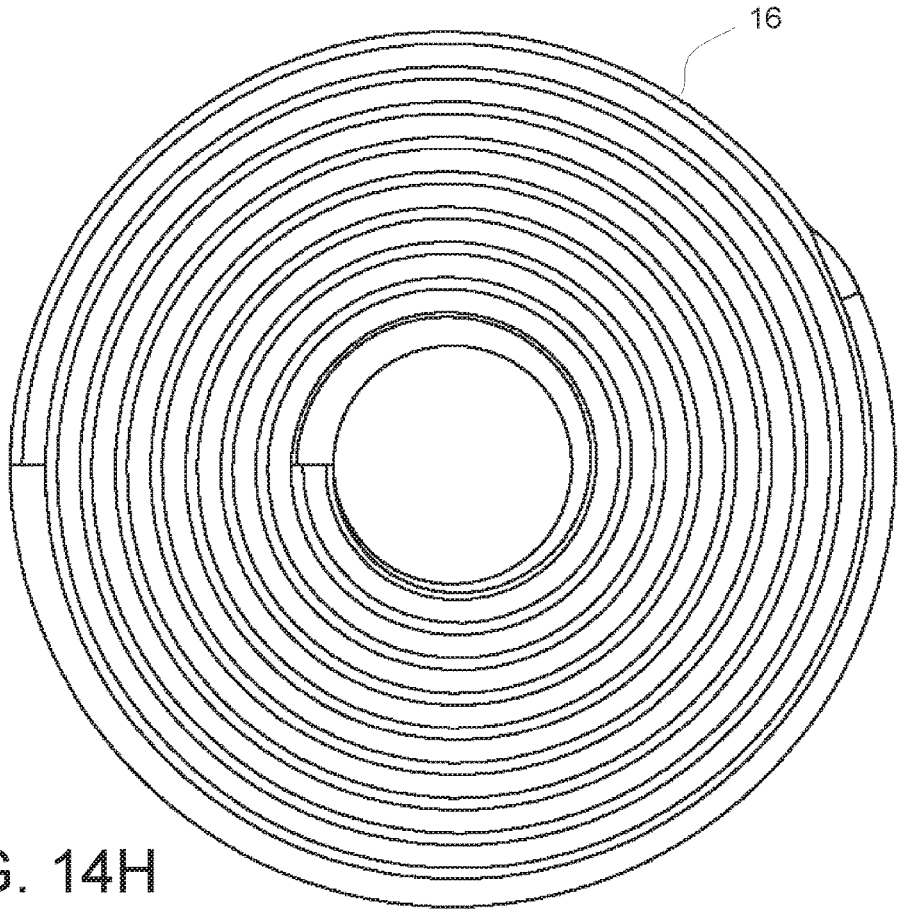
FIG. 14H is a top view drawing illustrating one embodiment of a spring.
Figure 14I:
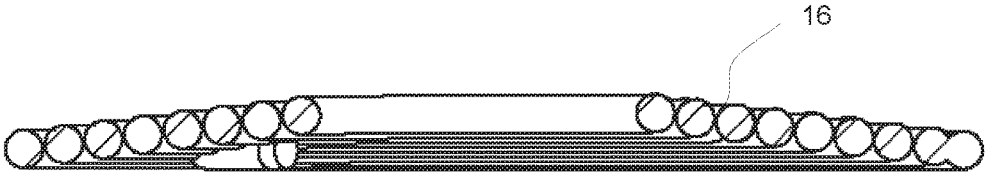
FIG. 14I is a side view cutaway drawing illustrating one embodiment of a spring.

FIG. 14H is a top view drawing illustrating one embodiment of the spring coils 16 of the compressed spring 110*b* of FIG. 14G.

FIG. 14I is a side view cutaway drawing illustrating one embodiment of a compressed spring 110*b*. In the depicted embodiment, each spring coil 116 of the nests completely within a neighboring spring coil 16. As a result, a spring segment 23 may have a compressed length 21 that is substantially equivalent to a diameter of each spring coil 116. As used herein, substantially equivalent refers to within plus or minus 50%.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A device comprising:

one wheel, wherein the wheel is disposed on a proximal end of a frame and comprises a groove that receives a cable at a lower portion of the wheel and a wheel bearing;

a brake disposed on a distal end of the frame and is connected to a given lever point and comprising a groove along a brake bottom that receives the cable;

the frame comprising an array of lever points disposed between the brake and the wheel;

a hanger connected to a given lever point and suspends a weight, wherein the weight applies a force about the wheel to the brake at a lever angle and a lever distance to control a rate of descent of the device along the cable, wherein the brake applies a first frictive force to the cable with a first force to surface area ratio in a direction of travel and a second frictive force opposite the direction of travel, and wherein the hanger is further connected to at least on sliding bar that slides within a slider groove; and a lower slot configured to receive the cable and to allow the device to be removed from the cable when the hanger is removed from the given lever point.

2. The device of claim 1, the device further comprising a brake stop that applies a downward force to the brake in response to impacting a receiver.

3. The device of claim 1, the device further comprising an active brake that applies an active braking force to the brake.

4. The device of claim 1, further comprising safety carabiner holes disposed above the cable, where a carabiner is inserted through the carabiner holes and around the cable.

5. The device of claim 1, wherein the wheel bearing is selected from the group consisting of a Sprague bearing and a trapped bearing.

6. The device of claim 5, wherein the Sprague bearing prevents roll back at a stopping point.

7. The device of claim 1, wherein the brake traverses a top of the cable.

8. The device of claim 1, wherein the array of lever points comprises at least one hole at each lever point and the hanger connects to the at least hole.

9. The device of claim 1, wherein the given lever point is selected as a function of a slope of the cable.

10. The device of claim 1, the device further comprising a brake stop and at least one spring segment, wherein the at least one spring segment comprises a plurality of spring coils, the brake stop receives the at least one spring segment and compresses the at least one spring segment, and the spring coils of the compressed at least one spring segment nests completely within a neighboring spring coil.

11. The device of claim 1, wherein the frame is formed of one or more of ultra-high molecular weight polyethylene (UHMW), Titanium, Stainless Steel and high-strength carbon steel.

12. The device of claim 1, wherein the brake is formed of a material with a melting point in excess of 300° F.

13. A system comprising:

at least one spring segment, wherein each spring segment comprises at least one spring coil;

a receiver disposed on a first spring;

one wheel, wherein the wheel is disposed on a proximal end of a frame and comprises a groove that receives a cable at a lower portion of the wheel and a wheel bearing;

a brake disposed on a distal end of the frame and is connected to a given lever point and comprising a groove along a brake bottom that receives the cable;

a brake stop that that applies a downward force to the brake in response to impacting the receiver;

the frame comprising an array of lever points disposed between the brake and the wheel;

a hanger connected to a given lever point and suspends a weight, wherein the weight applies a force about the wheel to the brake at a lever angle and a lever distance to control a rate of descent of the device along the cable, wherein the brake applies a first frictive force to the cable with a first force to surface area ratio in a direction of travel and a second frictive force opposite the direction of travel;

a lower slot configured to receive the cable and to allow the device to be removed from the cable when the hanger is removed from the given lever point.

14. The system of claim 13, the device further comprising an active brake that applies an active braking force to the brake.

15. The system of claim 13, wherein the spring coils of the compressed at least one spring segment nests completely within a neighboring spring coil.

16. The system of claim 13, wherein the array of lever points comprises at least one hole at each lever point and the hanger connects to the at least hole.

17. The system of claim 13, wherein the given lever point is selected as a function of a slope of the cable.

18. The system of claim 13, wherein the given lever point is selected as a function of a desired speed.

* * * * *